US005146131A

United States Patent [19]

Derks

[11] Patent Number: 5,146,131

[45] Date of Patent: Sep. 8, 1992

[54] ALKALINE EARTH METAL OXIDE CATHODE CONTAINING RARE EARTH METAL OXIDE

[75] Inventor: Petrus J. A. M. Derks, Eindhoven, Netherlands

[73] Assignee: U.S. Philips Corporation, New York, N.Y.

[21] Appl. No.: 759,723

[22] Filed: Sep. 11, 1991

Related U.S. Application Data

[63] Continuation of Ser. No. 221,809, Jul. 20, 1988, abandoned.

[30] Foreign Application Priority Data

Jul. 23, 1987 [NL] Netherlands ..... 8701739

[51] Int. Cl.[5] ..... H01J 1/14; H01J 1/20

[52] U.S. Cl. ..... 313/346 R

[58] Field of Search ..... 313/346 R, 346 DC; 252/513, 521

[56] References Cited

U.S. PATENT DOCUMENTS

| | | | |
|---|---|---|---|
| 3,719,856 | 3/1973 | Koppius | 313/346 DC |
| 4,675,570 | 6/1987 | Green | 313/346 DC |
| 4,752,713 | 6/1988 | Buxbaum | 313/346 R |

*Primary Examiner*—Palmer C. DeMeo
*Attorney, Agent, or Firm*—John C. Fox

[57] ABSTRACT

The zero-hour emission of oxide cathodes comprising for example BaO.SrO as an emissive material is improved by adding europium oxide or ytterbium oxide. Moreover, addition of lutetium oxide improves the lifetime properties.

6 Claims, 1 Drawing Sheet

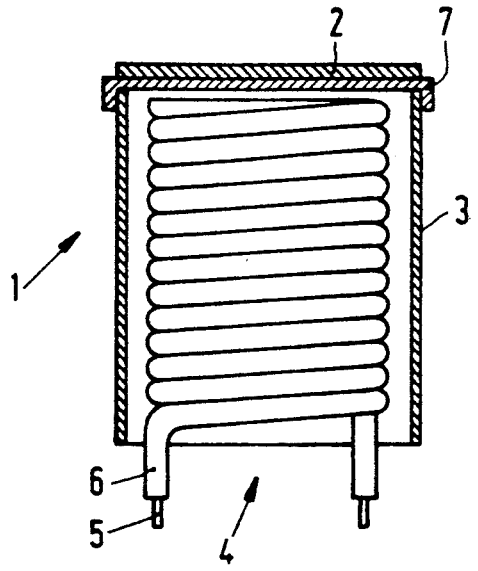
2
7
3
1
6
5
4

ALKALINE EARTH METAL OXIDE CATHODE CONTAINING RARE EARTH METAL OXIDE

This is a continuation of application Ser. No. 07/221,809, filed on Jul. 20, 1988, now abandoned.

BACKGROUND OF THE INVENTION

The invention relates to a cathode comprising a support of an alloy comprising mainly nickel and coated with a layer of electron emissive material comprising alkaline earth metal oxides and barium.

Such cathodes are generally known and are described, for example in "Advances in Electronics and Electron Physics" 25, 211-275 (1968). The emission of such cathodes is based on the release of barium from barium oxide. In addition to the barium oxide, the electron-emissive material usually comprises strontium oxide and sometimes calcium oxide.

The actual emission is mainly ensured by small regions (so-called "sites") having the lowest effective work function for electrons which are spread over the electron-emissive material. In practice, sites having a slightly higher work function will hardly contribute to the electron current generated by the cathode.

For a high effective electron emission it is therefore favourable to increase as much as possible the number of sites having a minimum possible work function in the total distribution of sites.

The addition of samarium oxide and thulium oxide and oxides of some other rare earth metals is proposed in European Patent Application EP 0,210,805 for the purpose of life-time improvements, with scandium oxide or yttrium oxide being preferred.

However, the additions mentioned in this Application are found to yield a very small or no zero-hour improvement and this may even be at the expense of a certain deterioration in the initial emission, notably with scandium oxide (see also, for example, FIG. 3 in EP 0,204,477).

SUMMARY OF THE INVENTION

A cathode according to the invention is characterized in that the electron-emissive material comprises at least one of the oxides europium oxide, ytterbium oxide or lutetium oxide.

In a preferred embodiment the electron-emissive material comprises 0.2-25% by weight, and in a further preferred embodiment at most 5% by weight of one of these rare earth metal oxides.

Experiments surprisingly proved that the zero-hour emission of cathodes of the type described in the opening paragraph could be considerably improved by the addition of europium oxide, while there was also some improvement when ytterbium oxide was added. A cathode to which europium oxide had been added resulted in a 28% increase of the saturation current and also in an improvement of a number of other zero-hour emission properties.

For example, the space charge-limited current measured under standard conditions was found to be approximately 4% higher both when 2% by weight of europium oxide and when 2.5% by weight of ytterbium oxide were added, as compared to cathodes without any additions.

The addition of lutetium oxide per se yields a little improvement in the zero-hour emission, but is very suitable for improving the lifetime properties of the cathodes, if it is added separately or in combination with one of the two other oxides.

The favourable effect of the addition of lutetium oxide was notably apparent in lifetests. A cathode in which a combination of approximately 2% by weight of europium oxide and approximately 2.5% by weight of lutetium oxide had been added to the emissive layer was found to be superior to a cathode in which approximately 5% by weight of yttrium oxide had been added to the emissive layer.

BRIEF DESCRIPTION OF THE DRAWINGS

The invention will now be described in greater detail by way of example with reference to an embodiment and the accompanying drawing in which the FIGURE shows a cathode according to the invention in a diagrammatic cross-section.

DESCRIPTION OF THE PREFERRED EMBODIMENTS

The cathode 1 in FIG. 1 comprises in this embodiment a cylindrical nichrome cathode shank 3, provided with a cap 7. The cap 7 mainly consists of nickel and may comprise reducing means such as, for example silicon, magnesium, manganese, aluminium and tungsten. The cathode shank 3 accommodates a helically wound filament 4 comprising a metal helically wound core 5 and an electrically insulating aluminium oxide layer 6.

The cap 7 is provided with an approximately 70 μm thick layer of emissive material 2 which may be provided, for example, by spraying or by the method described in U.S. Pat. No. 4,197,152. The layer 2 comprises, for example a mixture of barium oxide and strontium oxide, or a mixture of barium oxide, strontium oxide and calcium oxide obtained by providing and subsequently decomposing barium strontium carbonate or barium strontium calcium carbonate.

According to the invention the layer 2 also comprises from about 0.2 to 25 weight percent (calculated as a percentage of the quantity of barium strontium carbonate) of at least one of the rare earth oxides europium oxide, ytterbium oxide and lutetium oxide, for example, approximate 2% by weight of europium oxide, which in the case of spraying may be added in the form of a powder to the spraying suspension. This yields a cathode having improved emission properties.

As already stated a saturation current approximately 28% higher was measured on such a cathode with europium oxide as compared to a cathode without the europium oxide.

An improvement of the emission by addition of europium or ytterbium oxide to the spraying suspension was also found in the so-called space charge region upon testing immediately after manufacture and activation (so-called zero-hour tests). For a cathode having a 2% by weight addition of europium oxide and a cathode having a 2.5% by weight addition of ytterbium oxide, and at otherwise identical conditions, space charge-limited emission currents were measured which were 4% higher than for identical cathodes without addition of europium oxide or ytterbium oxide.

Also the point where the emission current in a cathode ray tube is 10% lower upon a decrease of the filament voltage with respect to the voltage from which this emission current is further substantially only determined theremally (the so-called roll-off point) was 0.2 V lower than in the cathodes without europium oxide or ytterbium oxide.

The cathodes according to the invention can therefore be operated at a filament voltage which is at least 0.2 V lower while the emission remains the same. This implies that the cathode temperature can be chosen to be approximately 25° C. lower, which in practice corresponds to an approximate doubling of the lifetime.

Lifetests surprisingly showed that the variation in emission properties was considerably less than in the conventional cathodes, even at an unchanged filament voltage, when lutetium oxide was added, whether or not in combination with europium oxide or ytterbium oxide. These cathodes therefore have a longer lifetime in the case of an equal or even higher load.

This is illustrated by way of the following examples in which accelerated life test results were obtained for cathodes having different additions to the layer of emissive material. Emission properties were determined before and after 2000 operating hours at a filament voltage of 7 Volt, which is comparable with approximately 10,000 real operating hours.

The emission measurements (so-called $i_k$ measurements) before and after this lifetest were performed at a filament voltage of 6.3 V, after 30 sec. of conveying current at a cathode load of 2.2 A/cm$^2$. Results are presented in the following Table.

| Type of addition to emissive layer | Reduction of emission ($\Delta i_k$) (%) |
|---|---|
| none (reference) | 41 |
| 2.5% by weight of $Lu_2O_3$ | 18.5 |
| 2.5% by weight of $Yb_2O_3$ | 9 |
| 2% by weight of $Eu_2O_3$ + 2.5% by weight of $Lu_2O_3$ | 10 |
| 5% by weight of $Y_2O_3$ | 18 |

As may be seen from the Table, with the additions used, cathodes were obtained whose emission behaviour on a long term improved by a factor of 2–4, while notably a cathode with the combination of europium oxide and lutetium oxide improved considerably more than a cathode to which an approximately equal (total) quantity of yttrium oxide was added.

The invention is not limited to the embodiment shown, but several variations within the scope of the invention are possible to those skilled in the art. For example, the shape of the cathode may be changed in various ways (cylindrical, concave, convex, etc.).

What is claimed is:

1. A cathode comprising a support of an alloy comprising mainly nickel and a layer of electron-emissive material on the support, the layer comprising alkaline earth metal oxides and at least comprising barium, characterized in that the electron-emissive material further comprises about 0.2–5% by weight of at least one of the rare earth oxides selected from the group consisting of europium oxide and ytterbium oxide.

2. A cathode as claimed in claim 1 in which the alkaline earth metal oxides comprise mainly barium oxide and strontium oxide.

3. A cathode as claimed in claim 1 in which the support comprises reduction means.

4. A cathode comprising a support of an alloy comprising mainly nickel and a layer of electron-emissive material on the support, the layer comprising alkaline earth metal oxides and at least comprising barium, characterized in that the electron-emissive material further comprises about 0.2–5% by weight of a combination of europium oxide and lutetium oxide.

5. A cathode as claimed in claim 4, in which the electron-emissive material comprises mainly barium oxide and strontium oxide.

6. A cathode as claimed in claim 4, in which the support comprises reduction means.

* * * * *